US006903648B2

(12) United States Patent
Baumann et al.

(10) Patent No.: US 6,903,648 B2
(45) Date of Patent: Jun. 7, 2005

(54) OSCILLATING INDUCTOR

(75) Inventors: Michael Baumann, Hutthurm (DE); Johann Winkler, Hutthurm (DE)

(73) Assignee: Vogt Electronic AG, Obernzell (DE)

( * ) Notice: Subject to any disclaimer, the term of this patent is extended or adjusted under 35 U.S.C. 154(b) by 0 days.

(21) Appl. No.: 10/753,402

(22) Filed: Jan. 9, 2004

(65) Prior Publication Data

US 2004/0140775 A1 Jul. 22, 2004

Related U.S. Application Data

(63) Continuation of application No. PCT/EP02/07760, filed on Jul. 11, 2002.

(30) Foreign Application Priority Data

Jul. 11, 2001 (DE) ..... 101 33 601
Apr. 16, 2002 (DE) ..... 102 16 846

(51) Int. Cl.[7] ..... H01F 27/24
(52) U.S. Cl. ..... 336/212; 336/83; 336/233; 336/234
(58) Field of Search ..... 336/212, 83, 233, 336/234, 217, 213, 221

(56) References Cited

U.S. PATENT DOCUMENTS 4,352,080 A * 9/1982 Mitsui et al. ..... 336/83

FOREIGN PATENT DOCUMENTS

GB 1 466 880 3/1977
GB 1466880 * 3/1977

OTHER PUBLICATIONS

VOGT electronic, "Inductive Components", *Components Handbook,* 1999, 2000, 6 pages, no month.

* cited by examiner

*Primary Examiner*—Lincoln Donovan
*Assistant Examiner*—Jennifer A. Poker
(74) *Attorney, Agent, or Firm*—Rothwell, Figg, Ernst & Manbeck, PC

(57) ABSTRACT

An oscillating inductor has a symmetrical double-E core, which has two geometrically identical core windows, a cuboid center limb and two cuboid outer limbs. The double-E core is designed such that a longitudinal cross sectional area of the center limb is greater than 90 $mm^2$, with a longitudinal cross section being regarded as a cross section which would separate the double-E core into two single E-cores, and the cross section being at right angles to the longitudinal cross section such that the double-E can be identified in the cross section, with the double-E core being located in a component volume of less than 26.5 mm×26.5 mm×15 mm (width×depth×height).

21 Claims, 4 Drawing Sheets

OSCILLATING INDUCTOR

CROSS-REFERENCE TO RELATED APPLICATIONS

This application is a continuation of International Application No. PCT/EP02/07760, filed Jul. 11, 2002.

BACKGROUND OF THE INVENTION

1. Field of the Invention

The invention relates to oscillating inductors which are of wide distribution in electrical engineering.

2. Description of the Background Art

Nowadays, traditional standard kits from the E-core RM-range are preferably used in electronic ballasts for starting and operating fluorescent tubes, such as those described on pages 61-01 to 61-06 in the VOGT electronic AG "Inductive Component" catalogue from the year 2000.

The increase in voltage in order to start fluorescent lamps is achieved by means of a series resonant circuit formed from an LC combination. This is described, for example, on pages 60-04 and 60-05 in the already mentioned VOGT electronic AG catalogue. In this case, voltages of up to 4 $kV_{pp}$ are produced across the coils, and currents of up to 3.5 A, or more, have to be handled.

As a result of the required performance, these operating conditions for the starting coil or oscillating coil lead to air gaps up to a maximum of 8 mm, depending on the kit. Air gaps of this order of magnitude lead to high eddy current losses in the copper windings, caused by the stray field from the core. The low AL value (permeability times the form factor) caused by the large air gap necessitates a relatively large number of turns, and this necessarily leads to high copper losses ($P_v=I^2 \cdot R$). The high eddy current losses also mean that it is essential to use braids for oscillating inductors such as these. These braided structures have a number of disadvantages in comparison to solid wires. Their supply is more expensive, their temperature properties and their mechanical properties are not as good as those of normal varnished copper wires, braids are more difficult to wind than normal varnished copper wires and, finally, braids result in difficulties when fitting the wires to pins, owing to the unraveling effect.

In order to reduce the eddy current losses, some coils are nowadays cushioned, that is to say the distance between the winding and the core is artificially increased by introducing insulating films, or by injection of thick walls, into the coil former in the area of the air gap. This measure in turn necessarily leads to the overall component having a larger volume and to the available winding spaces being smaller.

SUMMARY OF THE INVENTION

In an entirely general form, the voltage which occurs between the individual winding layers in oscillating inductors, the so-called layer voltage, should be as small as possible. The varnish layer on the wires has to prevent a flashover within individual layers, which would be possible as a result of the appropriate potential difference. Furthermore, inter alia, small chamber widths w are required for this purpose, in order to keep the voltage between the individual layers as small as possible. In the case of the core and the coil former concept relating to this that is known from the prior art, the so-called concept of the horizontal core, as is illustrated schematically by way of example in FIG. 8, the winding window height b must be subdivided by three additional chamber walls which hold the winding space in order to achieve relatively small chamber widths w. This results in four chambers in order to make it possible to achieve the necessary withstand voltage.

The invention is based on the object of providing an oscillating inductor which is physically as simple as possible and which allows greater miniaturization to be achieved than in the case of the oscillating inductors which are known from the prior art, without in the process having to accept significant adverse affects on the electrical, magnetic and thermal data.

In the case of the oscillating inductors according to the invention, the stray field is minimized owing to the maximization of the magnetic cross section. For each of the oscillating inductors according to the invention, this is a result of the particular absolute dimensions of the core in the oscillating inductor. Furthermore, the physical height is minimized by rotating the magnetic axis from the horizontal (prior art) to the vertical. The large magnetic surface areas result in optimum magnetic and electrical shielding in the direction of the external field. Furthermore, this results in a reduction in the eddy current losses into the surrounding, closely adjacent housing from electronic ballasts by positioning of the air gap in the center of the space. The large rear flaps on the cores in the oscillating inductors according to the invention provide each of the oscillating inductors according to the invention with good cooling capabilities, to be precise both in the direction of the board and in the direction of the housing.

Owing to the smoothness of the surfaces of the symmetrical double-E core in the oscillating inductor according to one aspect of the invention and of the E-I core in the oscillating inductor according to another aspect of the invention, the respectively corresponding oscillating inductor according to the invention can be picked up by suction or gripped automatically so that it is suitable for fully automated component-placement methods.

If the core is wound using a solid wire, there is no braid, which in turn overcomes the disadvantages described above with reference to braids. There is no need for the braid, owing to the minimal stray field in the air gap area and owing to the reduced number of turns resulting from the large effective magnetic cross section. In this embodiment, the higher filler factor resulting from the use of solid wires means that more copper can be introduced into the winding space than in the case of a braided winding. This results in a reduction in the resistive losses, which, overall, compensates for the majority of the undesirable frequency losses with solid wires, such as eddy current losses (which are relatively small owing to the small air gap and the small number of turns), skin effects and the proximity effect.

BRIEF DESCRIPTION OF THE DRAWINGS

Exemplary embodiments of the inventions will be explained in the following text with reference to figures, in which.

DETAILED DESCRIPTION OF THE INVENTION

Quite fundamentally, the following explanatory notes should be preceded at this point by the following: even though the explanatory notes in the following text essentially relate to the description of the exemplary embodiments with a double-E core or with a double-EQ core, the explanatory notes also apply in an entirely corresponding manner to E-I cores and even, in a general manner, to core shapes with a center limb 17 and two outer limbs 18, 19. This is because the oscillating inductor properties that are required according to the object can also be achieved by such general core solutions. The only critical factors in each case are the criteria as defined in the individual independent patent claims.

The basic configuration of oscillating inductors according to the invention with a symmetrical double-E core which has two geometrically identical core windows, a cuboid center limb 17 and two cuboid outer limbs 18, 19 is directly evident when FIGS. 1, 2, 5, 6 and 7 are considered together.

Figure 1:
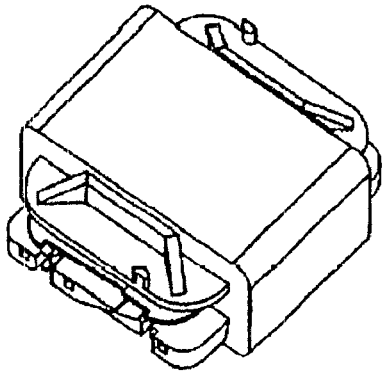
FIG. 1 shows an exemplary embodiment of an oscillating inductor according to the invention.
Figure 2:
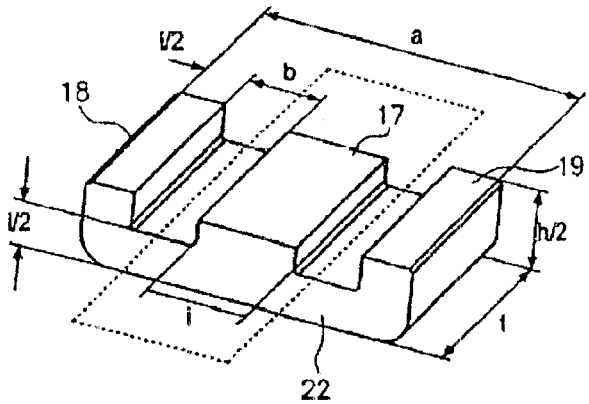
FIG. 2 shows one half of a symmetrical double-E core from the oscillating inductor shown in FIG. 1.

FIG. 1 shows an exemplary embodiment of an oscillating inductor according to the invention, while FIG. 2 shows one half of the symmetrical double-E core from the oscillating inductor shown in FIG. 1. The letters in FIG. 2 denote the following lengths:

a—overall length of the double-E core, b—width of a core window, h—overall height of the double-E core, i—width of the center limb 17, t—depth of the double-E core $I_w$—center turn length.

In the exemplary embodiment of the oscillating inductor according to the invention as illustrated in FIGS. 1 and 2, the two outer limbs 18, 19 of the symmetrical double-E core are in each case half as wide as its center limb 17 with the stated tolerances according to the appropriate laws, and the height of each of the two rear plates 22 (see also FIGS. 6 and 7) of the double-E core is in each case half as great as the width (i) of its center limb 17.

Figure 3:
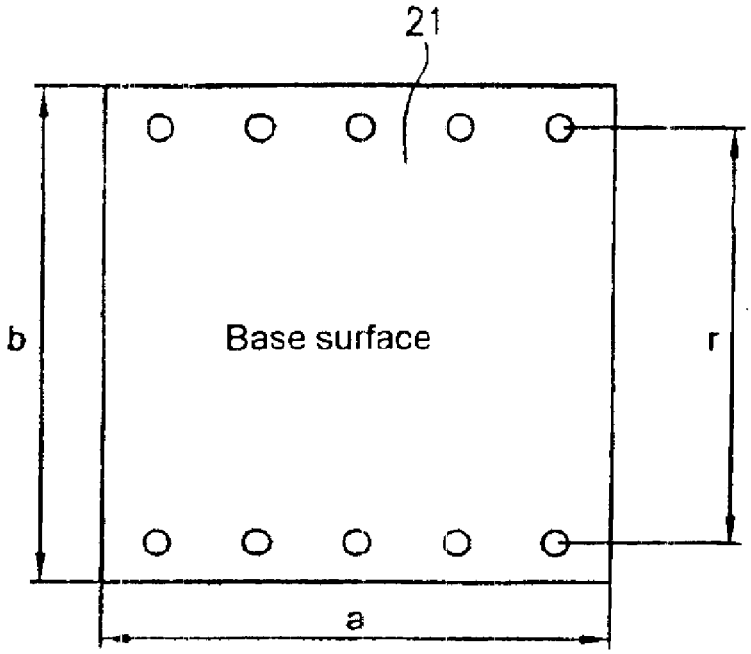
FIG. 3 shows, schematically, a board which is provided with a hole grid and is specified on a customer-specific basis, on which one exemplary embodiment of an oscillating inductor according to the invention is intended to be mounted.
Figure 4:
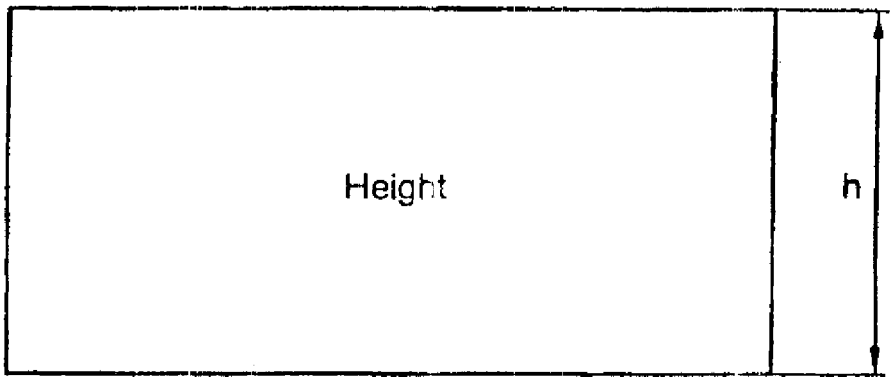
FIG. 4 shows, schematically, a height preset, which is associated with the board shown in FIG. 7 and is specific to one customer, for the exemplary embodiment of the oscillating inductor according to the invention.

A board 21 which is provided with a hole grid and on which one exemplary embodiment of an oscillating inductor according to the invention is intended to be mounted is a specific customer requirement. One example of a board 21 such as this with a hole grid is illustrated in FIG. 3, while FIG. 4 shows a customer-specific height preset, which is associated with the board 21 shown in FIG. 3, for the exemplary embodiment of the oscillating inductor according to the invention.

This results, as in exemplary embodiments for example, in two customer-specific variants with the following specific dimensions:

| 1st Variant in mm: | | 2nd variant in mm | |
|---|---|---|---|
| $l = 7.5_^{0}_{0.4}$ | mean: 7.3 mm | $l = 7.5_^{0}_{0.4}$ | mean: 7.3 mm |
| $t = 15.25_^{0}_{0.5}$ | mean: 15.0 mm | $t = 17.5_^{0}_{0.5}$ | mean: 17.25 mm |
| $h = 13.8_^{0}_{0.4}$ | mean: 13.6 mm | $h = 13.8_^{0}_{0.4}$ | mean: 13.6 mm |
| $a = 25.0_^{0.8}_{0.7}$ | mean: 25.0 mm | $a = 25.0_^{0.8}_{0.7}$ | mean: 25.0 mm |
| $b = 5.3_^{0.3}_{0.3}$ | mean: 5.3 mm | $b = 5.3_^{0.3}_{0.3}$ | mean: 5.3 mm |

This results in the mean longitudinal cross sectional area of the center limb being $i \cdot t = 7.3\ mm \cdot 15.0\ mm = 109.5.^{4.9}_{4.8}\ mm^2$. The mean longitudinal cross-sectional area of a core window is $b \cdot (h - i/2 - i/2) = 5.3\ mm \cdot 6.3\ mm = 33.4.^{4.1}_{3.9}\ mm^2$. In this case, the longitudinal cross section should be regarded as the cross section which would separate the double-E core into two single E-cores. The cross section is at right angles to the longitudinal cross section such that the double-E can be identified in the cross section.

Figure 5:
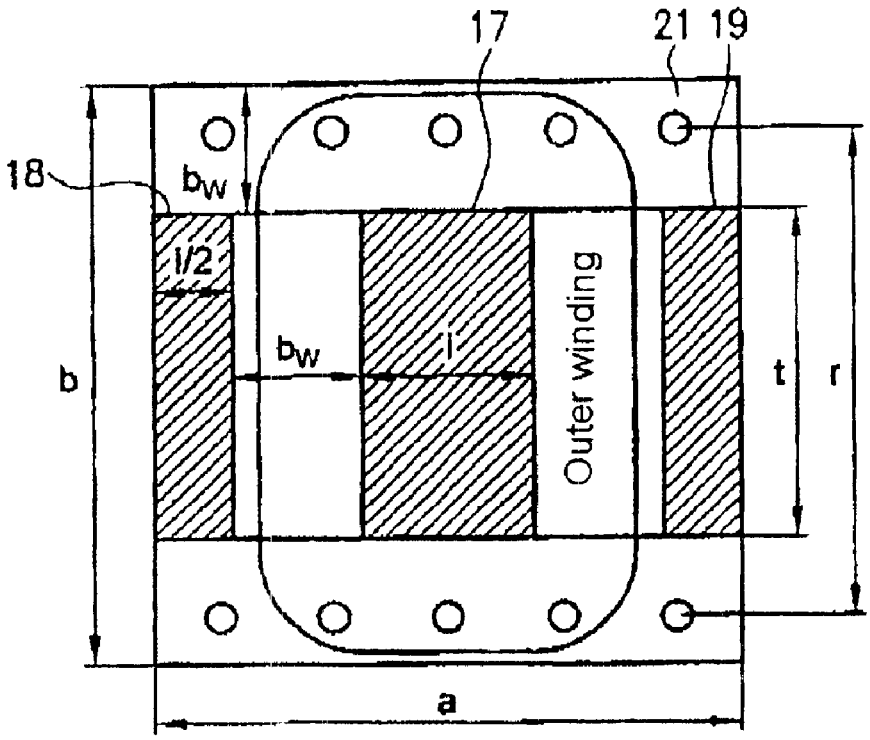
FIG. 5 shows schematically and in the form of a plan view one exemplary embodiment of an oscillating inductor according to the invention fitted to the board shown in FIG. 7.
Figure 6:
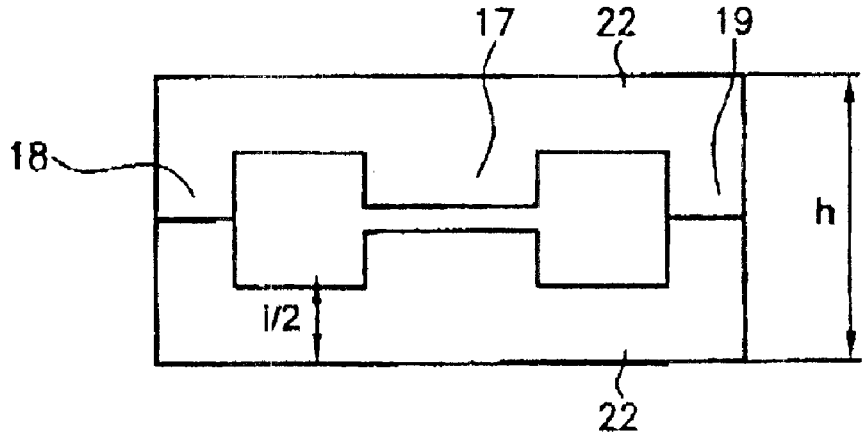
FIG. 6 shows schematically in the form of a side view a double-E core, which is associated with the height preset shown in FIG. 8, for the oscillating inductor according to the invention shown in FIG. 9.

FIG. 5 illustrates, schematically and in the form of a plan view, one exemplary embodiment of an oscillating inductor according to the invention such as this fitted to the board 21 shown in FIG. 3 and FIG. 6 shows, schematically and in the form of a side view, a double-E core, which is associated with the height preset shown in FIG. 5, for the exemplary embodiment of the oscillating inductor according to the invention shown in FIG. 6.

In the last-mentioned exemplary embodiment of the oscillating inductor according to the invention, the mean quotient of the longitudinal cross sectional area of the center limb 17 and the cross sectional area of a core window of the double-E core is 3.3. Taking the tolerances into account, this results in 2.8–3.9. In other exemplary embodiments of the oscillating inductor according to the invention, this ratio is higher or lower, for example being 3.7 for the variant 2. Taking into account the tolerances, this results in the value for the second variant being 3.2–4.5, although this value is in any case greater than 2.3.

In many exemplary embodiments of the oscillating inductor according to the invention, the width i of the center limb 17 of the symmetrical double-E core is in the range from 6.0 mm to 8.0 mm, but in other exemplary embodiments of the oscillating inductor according to the invention, it is also possible to use greater or lesser widths i for the center limb 17 of the symmetrical double-E core.

Furthermore, with regard to the depth t of the symmetrical double-E core, there are a wide range of different exemplary embodiments of the oscillating inductor according to the invention. For example, the depth t of the symmetrical double-E core may thus be greater than 13 mm or even greater than 18 mm, may be in the range between 13 mm and 18.0 mm, or in other exemplary embodiments of the oscillating inductor according to the invention may also have other values.

In many exemplary embodiments of the oscillating inductor according to the invention, the height h of the symmetrical double-E core is less than 15.25 mm, and is in the range from 13 mm to 15 mm. Other exemplary embodiments of the oscillating inductor according to the invention also, however, have other heights h, that is to say greater or lesser heights h, for the symmetrical double-E core.

In many exemplary embodiments of the oscillating inductor according to the invention, the overall width a of the symmetrical double-E core is less than 26.5 mm and is in the range from 24 mm to 26 mm. However, there are also exemplary embodiments of the oscillating inductor according to the invention in which the width a of the symmetrical double-E core is greater than 26.5 mm or less than 24 mm.

In the exemplary embodiment of the oscillating inductor according to the invention as illustrated in FIG. 1, the symmetrical double-E core is composed of manganese-zinc power ferrite.

Figure 9:
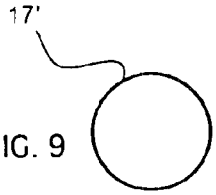
FIG. 9 illustrates a round center limb.
Figure 10:
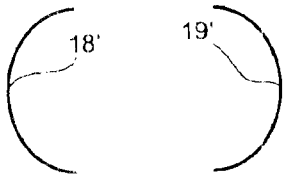
FIG. 10 shows two concave shapes.

In addition to the exemplary embodiments of oscillating inductors according to the invention as described above with a symmetrical double-E core, there are also corresponding exemplary embodiments of oscillating inductors according to the invention with a symmetrical double-EQ core. In some exemplary embodiments, the double-E core or the double-EQ core in this case have two geometrically identical winding windows, a cuboid center limb or a round center limb (the surface 17' of which is schematically shown in FIG. 9,) and two cuboid outer limbs or two outer limbs which are curved in a concave shape (18' and 19', see FIG. 10) on the inside as schematically shown in FIG. 10.

In many exemplary embodiments of oscillating inductors according to the invention, the width of the center limb of the E-core or of the EQ-core is in the range from 6.0 mm to 8.0 mm, but in other exemplary embodiments of oscillating inductors according to the invention, it is also possible to use smaller or larger widths for the center limb.

There are also a wide range of different exemplary embodiments of oscillating inductors according to the invention in terms of the depth of the symmetrical E-core or EQ-core. For example, the depth of the symmetrical double-E core or of the symmetrical double-EQ core may be greater than 13 mm, or even greater than 18 mm.

In many exemplary embodiments of oscillating inductors according to the invention, the height of the symmetrical double-E core or of the symmetrical double-EQ core is less than 15.25 mm and is in the range from 13 mm to 15 mm. Other exemplary embodiments of oscillating inductors according to the invention also, however, have other heights, that is to say greater or lesser heights, for the symmetrical double-E core or for the symmetrical double-EQ core.

In many exemplary embodiments of oscillating inductors according to the invention, the overall width of the symmetrical double-E core or of the symmetrical double-EQ core is less than 26.5 mm, and is in the range from 24 to 26 mm. However, there are also exemplary embodiments of oscillating inductors according to the invention in which the width of the symmetrical double-E core or of the symmetrical double-EQ core is greater than 26.5 mm or less than 24 mm.

Figure 7:
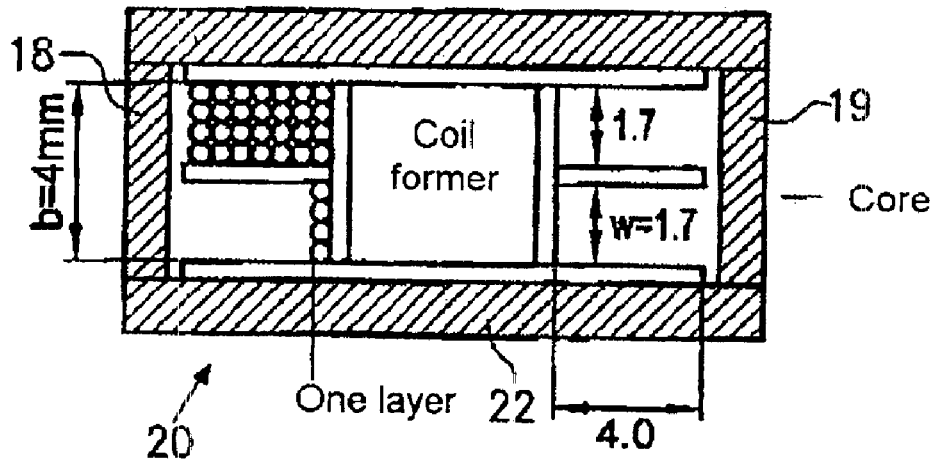
FIG. 7 shows, schematically, one exemplary embodiment of an oscillating inductor according to the invention having a vertical E-core.

FIG. 7 illustrates, schematically, one exemplary embodiment of an oscillating inductor according to the invention with a vertical E-core. In this concept of the vertical core, the broad faces 22 of the core rest on the board 21 (see FIG. 4). In this concept, a corner pin 20 for insertion into the board 21 can be seen on the left, at the bottom, in FIG. 6.

Figure 8:
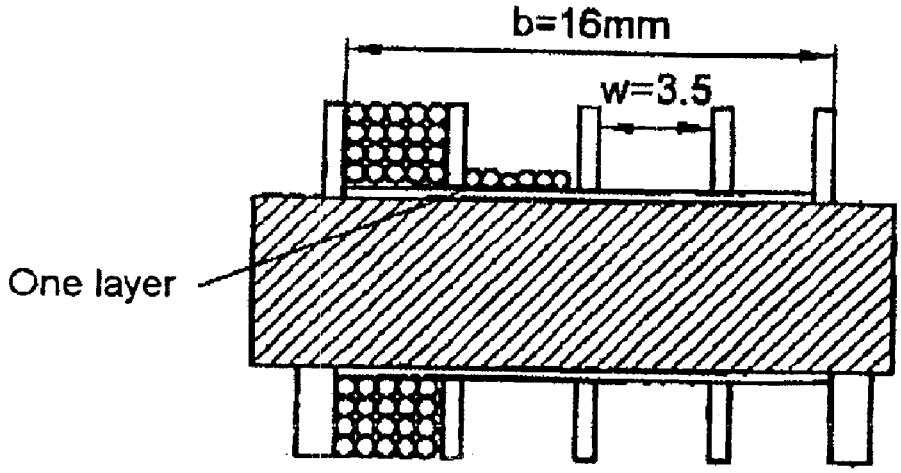
FIG. 8 shows, schematically, an oscillating inductor as is known from the prior art with a horizontal E-core.

If the exemplary embodiment of an oscillating inductor according to the invention and having a vertical E-core which is illustrated schematically in FIG. 7 is compared with the oscillating inductor which is known from the prior art, has a horizontal E-core and is illustrated schematically in FIG. 8, then the difference which has already been mentioned further above is evident. Owing to the small winding window width b of the vertical E-core concept (FIG. 7), the winding window width b need be subdivided by only one chamber wall in order to achieve a relatively narrow chamber width w and thus low layer voltages. This results in two chambers. In the old, horizontal concept, on the other hand (FIG. 8), the winding window height b must be subdivided by three additional chamber walls, which hold the winding spaces, in order to achieve relatively narrow chamber widths w. This results in four chambers in order to make it possible to achieve the necessary withstand voltage. The particular feature of the new, vertical E-core concept is that the design means that only one chamber wall and thus only two chambers are necessary in order to keep the layer voltage between the individual layers sufficiently low. Furthermore, less winding space is lost with one chamber wall.

As has already been explained expressly above, at the start of the exemplary notes relating to the exemplary embodiments, the above explanatory notes for exemplary embodiments of oscillating inductors with a double-E core or with a double-EQ core can also be transferred in a completely corresponding manner to exemplary embodiments of oscillating inductors with other core shapes which have a center limb and two outer limbs. The limbs may in this case be configured in widely differing ways. The center limb may, for example, be rectangular, rectangular with rounded corners, elliptical or circular. The outer limbs are in this case generally shaped so as to model the external winding contour, which is defined by the shape of the center limb. Plate-core solutions also exist in this case, in addition to double-core solutions.

One such plate-core solution is, for example, an exemplary embodiment of an oscillating inductor according to the invention having an E-I core. The E-I core solution comprises an E-core with longer limbs, combined with a plate, with the air gap being located directly under the plate, exclusively in the E-core. The basic dimensions of the said exemplary embodiment of the oscillating inductor according to the invention with an E-I core correspond to those for the double-E core solution that has been explained in detail above.

What is claimed is:

1. An oscillating inductor having a symmetrical double-E core, which has two geometrically identical core windows, a cuboid center limb and two cuboid outer limbs, wherein said double-E core is designed such that a longitudinal cross sectional area of said center limb is greater than 90 $mm^2$, with a longitudinal cross section being regarded as a cross section which would separate said double-E core into two single E-cores, and said cross section being at right angles to said longitudinal cross section such that said double-E can be identified in said cross section, with said double-E core being located in a component volume of less than 26.5 mm ×26.5 mm ×15 mm (width ×depth ×height).

2. An oscillating inductor having a symmetrical core, which has two geometrically identical core windows, a round center limb and two outer limbs which are curved in a concave shape on an inside thereof, wherein said core is designed such that a longitudinal cross sectional area of said center limb is greater than 90 $mm^2$, with a longitudinal cross section being regarded as a cross section which would separate said core into two single E-cores, and said cross section being at right angles to said longitudinal cross section such that said double-E can be identified in said cross section, with said core being located in a component volume of less than 26.5 mm ×26.5 mm ×15 mm (width ×depth ×height).

3. An oscillating inductor having a core with a center limb and two outer limbs, wherein said core is designed such that a longitudinal cross sectional area of said center limb is greater than 90 $mm^2$, with a longitudinal cross section being regarded as that cross section which runs parallel to a base surface of said core on which said limbs are seated, and said cross section being at right angles to said longitudinal cross section such that a shape which is at least approximately similar to an E, formed from the said base surface as said E rear surface and said three limbs, can be identified in said cross section, with said core being located in a component volume of less than 26.5 mm ×26.5 mm ×15 mm (width ×depth ×height).

4. The oscillating inductor as claimed in claim 3, wherein said core has two geometrically identical core windows.

5. The oscillating inductor as claimed in claim 1, wherein said longitudinal cross sectional area of the center limb is greater than 100 $mm^2$.

6. The oscillating inductor as claimed in claim 2, wherein said longitudinal cross sectional area of the center limb is greater than 100 $mm^2$.

7. The oscillating inductor as claimed in claim 3, wherein said longitudinal cross sectional area of the center limb is greater than 100 $mm^2$.

8. The oscillating inductor as claimed in claim 3, further comprising a second core with a center limb and two outer limbs, wherein the limbs of the first core and the second core face one another.

9. The oscillating inductor as claimed in claim 3, further comprising a plate which runs essentially parallel to the said base surface.

10. The oscillating inductor as claimed in claim 3, wherein said center limb is rectangular or rectangular with rounded corners, or is elliptical or circular.

11. The oscillating inductor as claimed in claim 3, wherein said outer limbs are shaped such that they model an external winding contour, which is defined by a shape of said center limb.

12. The oscillating inductor as claimed in claim 1, wherein a width of said center limb of said symmetrical double-E core is in a range from 6.0 mm to 8 mm.

13. The oscillating inductor as claimed in claim 2, wherein a width of said center limb of said symmetrical double-E core is in a range from 6.0 mm to 8 mm.

14. The oscillating inductor as claimed in claim 1, wherein the depth of said core is greater than or equal to 14.5 mm and the width of said core is less than 26.5 mm but greater than about 24 mm.

15. The oscillating inductor as claimed in claim 2, wherein the depth of said core is greater than or equal to 14.5 mm and the width of said core is less than 26.5 mm but greater than about 24 mm.

16. The oscillating inductor as claimed in claim 3, wherein the depth of said core is greater than or equal to 14.5 mm and the width of said core is less than 26.5 mm but greater than about 24 mm.

17. The oscillating inductor as claimed in claim 1, wherein said core is wound using solid wire, a ferrite core or composed of manganese-zinc power ferrite.

18. The oscillating inductor as claimed in claim 1, wherein each core is mounted on a board such that one of broad faces thereof rests flat on said board.

19. An oscillating inductor having a symmetrical double-E core, which has a cuboid center limb a first cuboid outer limb, a first rectangular core window between the center limb and the first outer limb, a second cuboid outer limb, and a second rectangular core window between the center limb and the second outer limb, wherein a longitudinal cross sectional area of said center limb is greater than 90 $mm^2$, with a longitudinal cross section being regarded as a cross section which would separate said double-E core into two single E-cores, and said cross section being at right angles to said longitudinal cross section such that said double-E can be identified in said cross section, with said double-E core being located in a component volume of less than 26.5 mm ×26.5 mm ×15 mm (width ×depth ×height), wherein the width of the center limb is between about 6.0 mm and 8.0 mm, the depth of the center limb is between about 13.0 mm and 18.0 mm, and the height of the center limb is between about 2.5 mm and 4.5 mm.

20. The inductor of claim 19, wherein the width of the core windows is about 5.3 mm.

21. The inductor of claim 20, wherein the width of each outer limb is about ½ the width of the center limb.

* * * * *